United States Patent [19]

Hori et al.

[11] 4,030,459

[45] June 21, 1977

[54] MULTICYLINDER ENGINE

[75] Inventors: Kenji Hori, Nagaokakyo; Shigeo Nakamura, Joyo, both of Japan

[73] Assignee: Mitsubishi Jidosha Kogyo Kabushiki Kaisha, Tokyo, Japan

[22] Filed: Dec. 29, 1975

[21] Appl. No.: 645,296

[52] U.S. Cl. ..... 123/52 M; 60/282

[51] Int. Cl.[2] ..... F02B 75/18; F02B 75/10

[58] Field of Search ..... 123/52 M, 52 MU, 127; 60/282, 301

[56] References Cited

UNITED STATES PATENTS

| | | | |
|---|---|---|---|
| 1,308,237 | 7/1919 | Goff et al. | 123/52 M |
| 3,708,980 | 1/1973 | Truxell | 60/301 |
| 3,827,237 | 8/1974 | Linder et al. | 60/301 |
| 3,934,411 | 1/1976 | Masaki et al. | 60/282 |
| 3,982,393 | 9/1976 | Masaki et al. | 60/282 |

FOREIGN PATENTS OR APPLICATIONS

| | | | |
|---|---|---|---|
| 524,778 | 8/1940 | United Kingdom | 123/3 |
| 127,850 | 6/1919 | United Kingdom | 123/52 M |

*Primary Examiner*—C. J. Husar
*Assistant Examiner*—Craig R. Feinberg
*Attorney, Agent, or Firm*—Wenderoth, Lind & Ponack

[57] ABSTRACT

Multicylinder having a pair of cylinders for over-concentrated mixed gas and a pair of cylinders for under-concentrated mixed gas, suction manifolds for supplying mixed gas to the cylinders respectively, a communication hole provided between the manifolds and opened or closed by an opening and closing valve which is controlled by means of a controlling device in response to negative pressure in the manifolds.

9 Claims, 5 Drawing Figures

MULTICYLINDER ENGINE

BACKGROUND OF THE INVENTION

As is well known, recently, with the rapid increase of the number of internal combustion engines, particularly in motor cars, pollution of atmospheric air by exhaust gas thereof has become a social problem. To solve this problem, various purifiers have been proposed. However, there have been many difficult Zproblems with these purifiers such as cost, purification capacity and mountability on the motorcar, etc.

Generally, in engines for a motor car, the mixing ratio of air and fuel supplied to each cylinder (hereinafter called the air fuel ratio) is designed so as to be substantially uniform, and in case of partial engine load, with an air fuel ratio set for minimum fuel consumption, the concentration of nitrogen oxide (hereinafter designated NOX) in the exhaust gas becomes high, and when the throttle is nearly full open, and the fuel ratio is set for maximum output, the concentration of carbon monoxide (hereinafter designated CO) and of hydrocarbon (hereinafter designated HC) are high. Therefore, the usual multicylinder engines have the disadvantages that the concentration of NOX, CO and HC for a fixed operating mode of exhaust gas measuring are high. However, as to CO and HC, when the engine is operated at a low number of revolutions the mixed gas is incompletely combusted in the cylinder due to the low temperature of the inner wall of the cylinder, etc., so that noxious exhaust gas containing combustible components such as CO, HC, etc. will be generated.

As to said CO and HC, as is well known, when they are efficiently burnt at a high temperature by supplying sufficient air, their concentration may be decreased, while as to NOX, the higher its combustion temperature becomes, the more the reaction of $N_2 + O_2$ 2NO − Q Kcal proceeds, thus increasing the concentration of NOX. Therefore, for the purpose of decreasing this NOX, it is necessary to lower engine efficiency by lowering the combustion temperature, and as one of its means of solution, an exhaust gas reflux system has been adopted, in which a part of the exhaust gas is sucked back into the intake. However, in such a system, since to combustion becomes unstable unless excess fuel is supplied, a mixed gas feeder for feeding an air-fuel mixture with a larger concentration of fuel than in the normal air-fuel ratio i.e. an over-concentration mixed gas, is operated at the same time as the exhaust gas reflux to supplement the supply of fuel for stabilizing the combustion. However, since it is necessary to control conditions so as to make the percentage of non-combustible gas nearly constant, including residual gas within the combustion chamber, there is the disadvantage that a device having a simple construction and low cash cannot be used for this system.

SUMMARY OF THE INVENTION:

This invention is directed to an improvement in a multicylinder engine, and is for overcoming the above mentioned various disadvantages.

The invention is based on the following three points.

1. NOX concentration is low with an over-concentrated air fuel ratio and under-concentrated air fuel ratio.

2. CO and HC concentration are high with over-concentrated air fuel ratio.

3. CO and HC concentration are low and oxygen concentration is high with under-concentrated air fuel ratio.

The invention has two aspects, the first relating to a multicylinder engine characterized in that it comprises a cylinder for over-concentrated mixed gas and a cylinder for under-concentrated mixed gas, a suction manifold for over-concentrated mixed gas, of which one end is connected with a forming device for over-concentrated mixed gas to supply the mixed gas to said cylinder for over-concentrated mixed gas, a suction manifold for under-concentrated mixed gas, of which one end is connected with a forming device for under-concentrated mixed gas to supply the mixed gas to said cylinder for under-concentrated mixed gas, a manifold communicating hole provided between said two suction manifolds, and an opening and closing valve provided in said communication hole. The second aspect relates to a multicylinder engine characterized in that it comprises a cylinder for over-concentrated mixed gas and a cylinder for under-concentrated mixed gas, a suction manifold for over-concentrated mixed gas, of which one end is connected with a forming device for over-concentrated mixed gas to supply the mixed gas to said cylinder for over-concentrated mixed gas, a suction manifold for under-concentrated mixed gas, of which one end is connected with a forming device for under-concentrated mixed gas to supply the mixed gas to said cylinder for under-concentrated mixed gas, a manifold communicating hole provided between said two suction manifolds, an opening and closing valve provided in said communication hole, and a detector for detecting the speed of revolution of the engine and a detector for detecting the negative pressure of manifold and operating said valve in response thereto to open said valve at a time of heavy load or high speed of revolution.

DESCRIPTION OF THE PREFERRED EMBODIMENTS

Figure 1A:
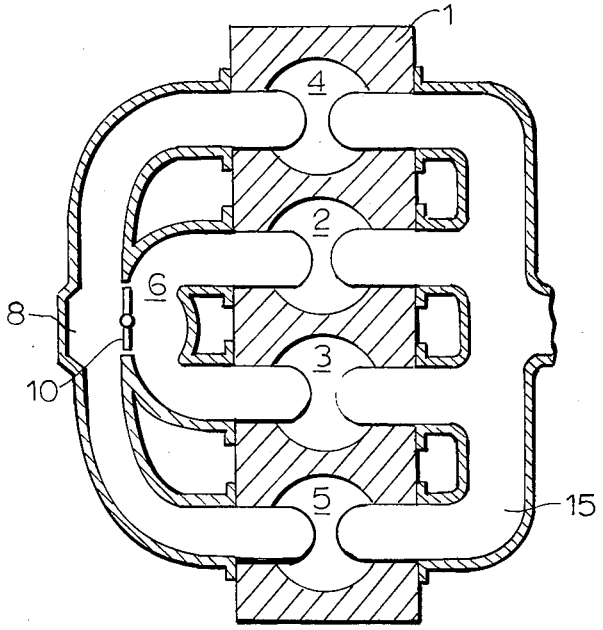
FIG. 1*a*, FIG. 2*a*, and FIG. 1*b* and FIG. 2*b* are schematic explanatory drawings of an embodiment according to this invention.

An embodiment according to this invention will be described with respect to the accompanying drawings FIG. 1*a*, FIG. 2*a*, and FIG. 1*b* and FIG. 2*b*.

It is to be understood that the embodiment is for a four cylinder engine, the firing order being 1st → 2nd → 4th → 3rd cylinders.

In the drawings, 1 is a cylinder head provided with cylinders 2 and 3 for over-concentrated mixed gas and cylinders 4 and 5 for under-concentrated mixed gas, 6 is a suction manifold for over-concentrated mixed gas, which is connected with a forming device 7 for over-concentrated mixed gas to supply mixed gas to said cylinders 2 and 3 for over-concentrated mixed gas, 8 is a suction manifold for under-concentrated mixed gas, which is connected with a forming device 9 for under-concentrated mixed gas to supply mixed gas to said cylinders 4 and 5 for under-concentrated mixed gas, 10 is an opening and closing valve provided in a manifold communication hole 11 between said two suction manifolds 6 and 8, 12 is a detector for detecting negative pressure in the suction manifold and provided on said suction manifold 8 for under-concentrated mixed gas or on said suction manifold 6 for over-concentrated mixed gas, 13 is a detector for detecting the speed of revolution of the engine from the electrical system mechanical system, etc., 14 is a valve operating device which will operate said opening and closing valve 10 according to signals generated by said detector 13 for the speed of revolution of the engine to open or close said manifold communication hole 11. 15 is a manifold reactor which is provided integrally with an exhaust manifold.

According to said construction, the case of normal partial load operation, for instance, when the negative pressure of the suction manifold is more than 100 mm Hg and the speed of revolution of the engine is less than 3,500 r.p.m., the mixed gas formed by said forming device for over-concentrated mixed gas and said forming device for under-concentrated mixed gas is respectively supplied to said cylinder for over-concentrated mixed gas and said cylinder for under-concentrated mixed gas, but since the gas will be ignited and burnt according to the firing order of the cylinders, i.e. in the 1 st → 2nd → 4th → 3rd cylinders, the combustions will take place alternately in said cylinder for over-concentrated mixed gas and in said cylinder for under-concentrated mixed gas. After combustion, exhaust gas from the cylinder for the over-concentrated mixed gas and exhaust gas from the cylinder for the under-concentrated mixed gas are supplied to said manifold reactor, unreacted oxygen of the exhaust gas of the under-concentrated mixed gas and the unburnt component of the exhaust gas of the over-concentrated mixed gas are reacted, with the result that exhaust gas from the manifold reactor will be fully purified.

During a heavy load operation, for instance, when negative pressure in the suction manifold is less than 100 mm Hg, or during operation at high speed, for instance, when speed is more than 3,500 r.p.m., said valve 10 is opened to open said manifold communication hole and said cylinders 2, 3, 4 and 5 are respectively supplied with mixed gas having the same air fuel ratio, and thus each cylinder will operate in the same manner as the usual multicylinder engine.

The above described operations will be explained with reference to FIG. 3.

Figure 3:
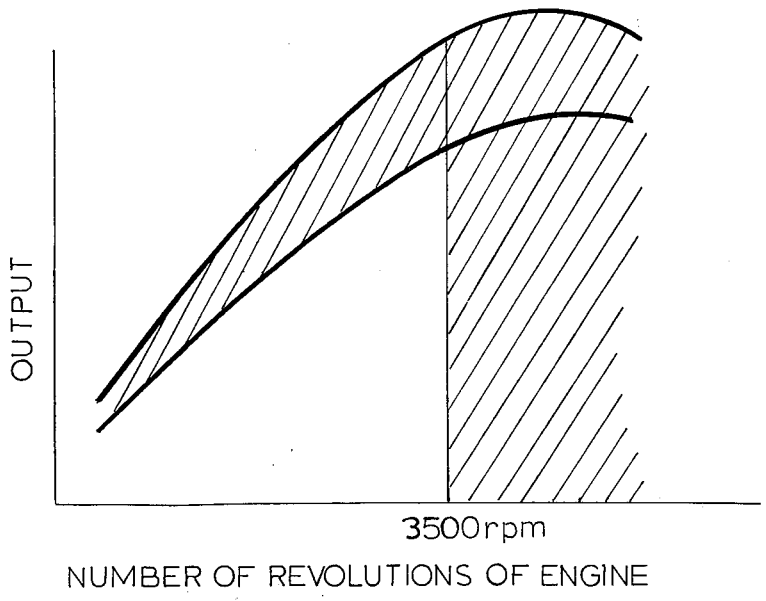
FIG. 3 is a graph for explaining the operation of said embodiment.

Particularly, during partial load operation wherein NOX is liable to be generated, for instance, the negative pressure of suction manifold is more than 100 mm Hg and the speed of revolution of the engine is less than 3,500 r.p.m., over concentrated mixed gas is supplied to the cylinder for over-concentrated mixed gas and under-concentrated mixed gas is supplied to the cylinder for under-concentrated mixed gas to suppress the generation of NOX, and during operation under a heavy load or at high speed, i.e. in the state of operation shown by oblique lines in FIG. 3, the same mixed gas of nearly the theoretical air fuel ratio is supplied to said each cylinder to prevent decrease of output, etc.

In the above embodiment, the description is of the case when the cylinders for over- and under-concentrated mixed gas are alternately subjected to combustion. However when a multicylinder engine is used, in which a pair of cylinders comprising in combination a cylinder in which over- and under-concentrated mixed gas are simultaneously subjected to combustion, the same function and effect may be obtained.

Figure 1B:
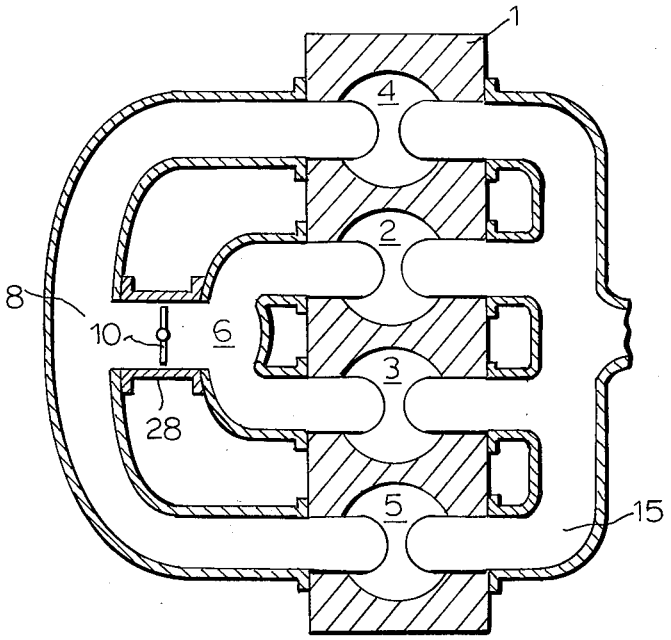

In FIG. 1*b*, there is shown a communicating vessel 28, which connects the over-concentrated mixed gas suction manifold 6 with the under-concentrated mixed gas suction manifold 8.

Figure 2A:
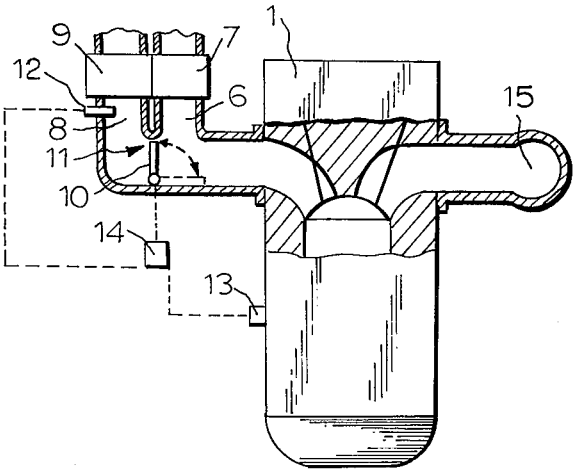
Figure 2B:
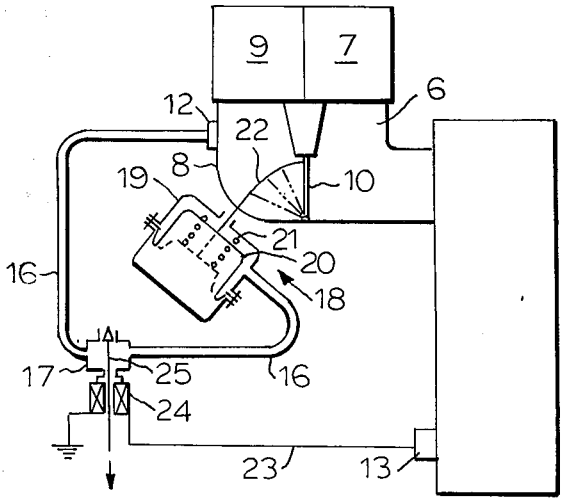

In FIG. 2*b*, when the speed of revolution is less than 3,500 r.p.m. and negative pressure of the suction manifold is transmitted to a negative pressure chamber 19 of a pressure differential device 18 through a negative pressure controlling device, a movable body 20 will move the valve 10 into the closed state by means of a rod 22 acting against a spring 21.

When the engine operating changes for instance, to a speed of more than 3,500 r.p.m. from the above state, electric current will flow in an electromagnetic circuit 23 due to the operation of the detector 13 for detecting the speed of revolution of the engine to excite a solenoid 24, so that a negative pressure valve 25 of the negative pressure controlling device is opened to admit atmospheric air into said negative pressure chamber, thus the valve 10 will be opened.

The detector 13 for detecting the speed of revolution of the engine is constructed in such a manner that within a range of the speed of revolution of engine other than idling, speed to about 3,500 r.p.m., it will cause electric current to flow through the solenoid 24 to operate the negative pressure valve 25, thus to supply the atmospheric air to the negative pressure inlet pipe 16.

What is claimed is:

1. Multicylinder engine, characterized in that it comprises a cylinder for over-concentrated mixed gas and a cylinder for under-concentrated mixed gas, a suction manifold for over-concentrated mixed gas, of which one end is connected with a forming device for over-concentrated mixed gas to supply the mixed gas to said cylinder for over-concentrated mixed gas, a suction manifold for under-concentrated mixed gas, of which one end is connected with a forming device for under-concentrated mixed gas to supply the mixed gas to said cylinder for under-concentrated mixed gas, a manifold communicating hold provided between said two suction manifolds, an opening and closing valve provided in said communication hole, and a detector for detecting the speed of revolution of the engine and a detector for detecting the negative pressure of the manifold to operate said valve, wherein said valve is opened to open said communication hole when the engine is operating at a heavy load or at a high rotational speed.

2. Multicylinder engine, characterized in that it comprises a cylinder for over-concentrated mixed gas and a cylinder for under-concentrated mixed gas, a suction manifold for over-concentrated mixed gas, of which one end is connected with a forming device for over-concentrated mixed gas to supply the mixed gas to said cylinder for over-concentrated mixed gas, a suction manifold for under-concentrated mixed gas, of which one end is connected with a forming device for under-concentrated mixed gas to supply the mixed gas to said cylinder for under-concentrated mixed gas, a manifold communicating hole provided between said two suction manifolds, an opening and closing valve provided in said communication hole, and a controlling device to control the degree opening and closing of said valve according to negative pressure of said suction manifold.

3. Multicylinder engine according to claim 2, said controlling device being so constructed that said valve is opened with a negative pressure of said suction manifold of less than about 100 mm Hg.

4. Multicylinder engine according to claim 2, wherein said manifold for over-concentrated mixed gas and said manifold for under-concentrated mixed gas are connected by means of a communicating vessel, in which said opening and closing valve is provided.

5. Multicylinder engine according to claim 2, wherein said valve is opened when the negative pressure in the suction manifold is less than about 100 mm Hg and the speed of revolution of the engine is more than about 3,500 r.p.m.

6. Multicylinder engine according to claim 2, wherein said controlling device comprises a movable member connected with said opening and closing valve, said movable member partitioning the chamber of a pressure responsive device, a negative pressure inlet pipe connected between the suction manifold and one portion of said partitioned chamber and having an opening therein to the atmosphere, a negative pressure controlling valve provided in the opening to the atmosphere, and a negative pressure controlling device which operates said negative pressure controlling valve at a speed of revolution of the engine which is greater than a predetermined speed and opens said negative pressure pipe to the atmosphere.

7. Multicylinder engine according to claim 2, wherein the degree of opening of said opening and closing valve is controlled in response to the change of negative pressure of said suction manifold for distributing the air fuel ratio of mixed gas supplied to said cylinder for over-concentrated mixed gas and the air fuel ratio of mixed gas supplied to said cylinder for under-concentrated mixed gas into desired values.

8. Multicylinder engine according to claim 2, wherein said opening and closing valve is opened at a negative pressure of the suction manifold of less than about 100 mm Hg and at a range of speed of the engine other than idling to about 3,500 r.p.m.

9. Multicylinder engine according to claim 2, further comprising an exhaust gas purifying device such as a thermal reactor, or catalyzer provided in the exhaust gas system of the engine.

* * * * *